US011054764B2

(12) United States Patent
Ikeuchi

(10) Patent No.: US 11,054,764 B2
(45) Date of Patent: Jul. 6, 2021

(54) IMAGE FORMING APPARATUS AND DEVELOPER CONVEYANCE SETTING METHOD

(71) Applicant: KYOCERA Document Solutions Inc., Osaka (JP)

(72) Inventor: Atsuya Ikeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/894,426

(22) Filed: Jun. 5, 2020

(65) Prior Publication Data

US 2020/0387087 A1 Dec. 10, 2020

(30) Foreign Application Priority Data

Jun. 7, 2019 (JP) ..... JP2019-107251

(51) Int. Cl.
*G03G 15/08* (2006.01)
*G03G 15/00* (2006.01)

(52) U.S. Cl.
CPC ..... *G03G 15/0891* (2013.01); *G03G 15/5004* (2013.01); *G03G 15/5008* (2013.01)

(58) Field of Classification Search
CPC ..... G03G 15/0849; G03G 15/0856; G03G 15/0877; G03G 15/0891
USPC ..... 399/27, 30, 258
See application file for complete search history.

(56) References Cited

U.S. PATENT DOCUMENTS 10,317,819 B2 * 6/2019 Koga ..... G03G 15/0891
10,732,541 B2 * 8/2020 Soda ..... G03G 15/0849

FOREIGN PATENT DOCUMENTS

JP 2006337818 A 12/2006

* cited by examiner

*Primary Examiner* — William J Royer
(74) *Attorney, Agent, or Firm* — Alleman Hall Creasman & Tuttle LLP

(57) ABSTRACT

An image forming apparatus includes a storage case, a developer conveyance portion, a developer detecting portion, a time measuring portion, and a driving control portion. The storage case stores developer that is supplied to a developing device, and conveys the developer by driving a first conveyance member. The developer conveyance portion conveys, by driving a second conveyance member, the developer supplied from the storage case. The developer detecting portion is provided in the developing device and detects the developer supplied from the developer conveyance portion. The time measuring portion measures a required time between a time when the first conveyance member starts to be driven and a time when the developer detecting portion detects the developer. The driving control portion sets a driving time of the second conveyance member based on the required time measured by the time measuring portion.

10 Claims, 9 Drawing Sheets

IMAGE FORMING APPARATUS AND DEVELOPER CONVEYANCE SETTING METHOD

INCORPORATION BY REFERENCE

This application is based upon and claims the benefit of priority from the corresponding Japanese Patent Application No. 2019-107251 filed on Jun. 7, 2019, the entire contents of which are incorporated herein by reference.

BACKGROUND

The present disclosure relates to an image forming apparatus and a developer conveyance setting method.

An electrophotographic image forming apparatus such as a printer for forming an image includes a toner storage portion storing toner that is supplied to a developing device configured to develop an electrostatic latent image. In this type of image forming apparatus, there is known an image forming apparatus including a toner conveyance portion that conveys the toner supplied from the toner storage portion to the developing device by driving a conveyance screw.

SUMMARY

An image forming apparatus according to an aspect of the present disclosure includes a storage case, a developer conveyance portion, a developer detecting portion, a time measuring portion, and a driving control portion. The storage case stores developer that is supplied to a developing device, and conveys the developer by driving a first conveyance member. The developer conveyance portion conveys, by driving a second conveyance member, the developer supplied from the storage case. The developer detecting portion is provided in the developing device and detects the developer supplied from the developer conveyance portion. The time measuring portion measures a required time between a time when the first conveyance member starts to be driven and a time when the developer detecting portion detects the developer. The driving control portion sets a driving time of the second conveyance member based on the required time measured by the time measuring portion.

A developer conveyance setting method according to another aspect of the present disclosure is executed in an image forming apparatus. The image forming apparatus includes a storage case and a developer conveyance portion. The storage case stores developer that is supplied to a developing device, and conveys the developer by driving a first conveyance member. The developer conveyance portion conveys, by driving a second conveyance member, the developer supplied from the storage case. The developer conveyance setting method includes a developer detecting step, a time measuring step, and a driving time setting step. The developer detecting step detects the developer supplied from the developer conveyance portion. The time measuring step measures a required time between a time when the first conveyance member starts to be driven and a time when the developer is detected in the developer detecting step. The driving time setting step sets a driving time of the second conveyance member based on the required time measured in the time measuring step.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

[Configuration of Image Forming Apparatus 100]

Figure 1:
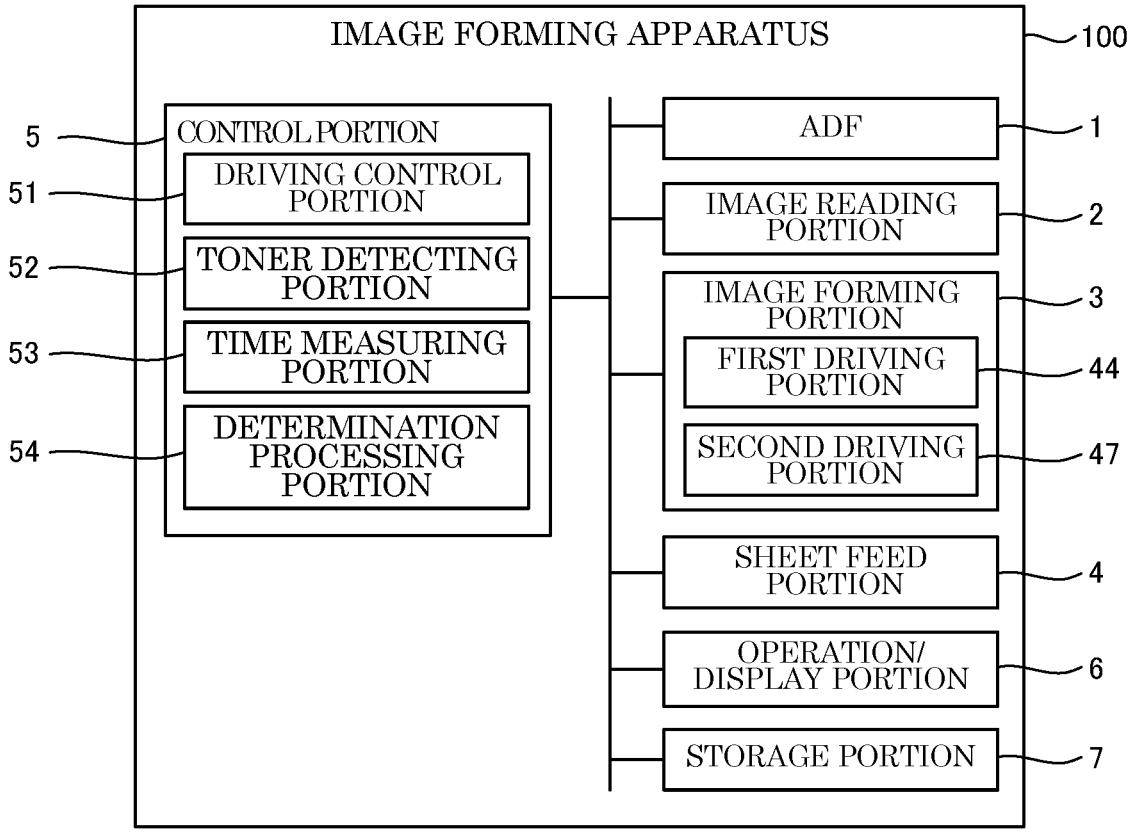
FIG. 1 is a diagram showing a system configuration of an image forming apparatus according to an embodiment of the present disclosure.
Figure 2:
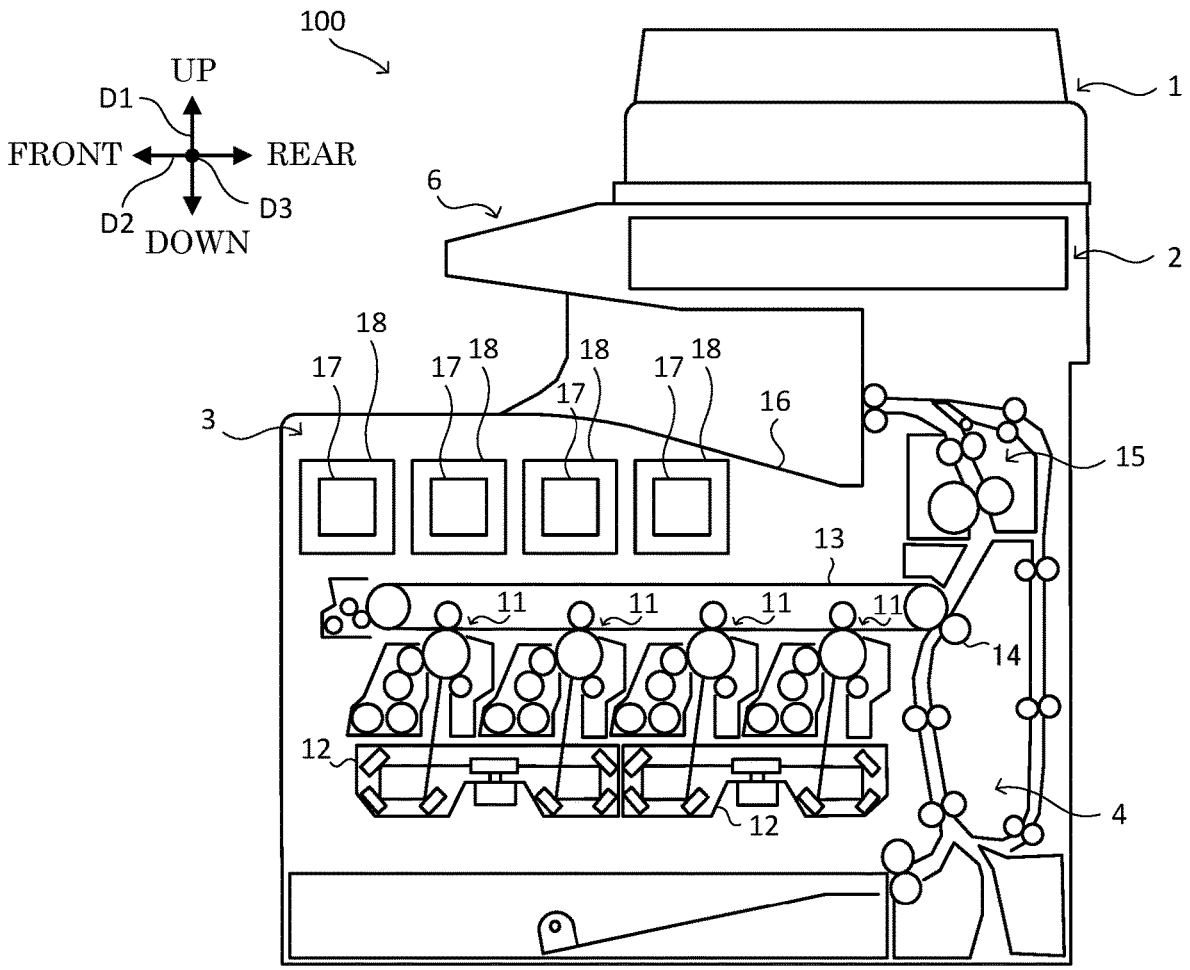
FIG. 2 is a diagram showing a configuration of the image forming apparatus according to the embodiment of the present disclosure.

First, a description is given of a configuration of an image forming apparatus 100 according to an embodiment of the present disclosure with reference to FIG. 1 and FIG. 2. Here, FIG. 2 is a schematic cross-sectional diagram showing a configuration of the image forming apparatus 100.

For the sake of explanation, an up-down direction D1 is defined as a vertical direction in a state where the image forming apparatus 100 is installed usably (the state shown in FIG. 2). In addition, a front-rear direction D2 is defined on the supposition that the left-side surface of the image forming apparatus 100 shown in FIG. 2 is a front side (front). Furthermore, a left-right direction D3 is defined based on the image forming apparatus 100 in the installation state viewed from the front side.

The image forming apparatus 100 is a multifunction peripheral having a plurality of functions including a print function to form an image based on image data, as well as a scan function, a facsimile function, and a copy function. It is noted that the image forming apparatus 100 may be a printer, a facsimile apparatus, or a copier.

As shown in FIG. 1, the image forming apparatus 100 includes an ADF (Automatic Document Feeder) 1, an image reading portion 2, an image forming portion 3, a sheet feed portion 4, a control portion 5, an operation/display portion 6, and a storage portion 7.

The ADF 1 includes a document sheet setting portion, a plurality of conveyance rollers, a document sheet pressing portion, and a sheet discharge portion, and feeds a document sheet so that the document sheet can be read by the image reading portion 2.

The image reading portion 2 includes a document sheet table, a light source, a plurality of mirrors, an optical lens, and a CCD, and is configured to read image data from the document sheet.

The image forming portion 3 is configured to form a color or monochrome image by an electrophotographic method based on image data read by the image reading portion 2. In addition, the image forming portion 3 is configured to form an image based on image data input from an external information processing apparatus. It is noted that the image forming portion 3 may be configured to form only a monochrome image.

The sheet feed portion 4 includes a sheet feed cassette and a plurality of conveyance rollers, and supplies a sheet to the image forming portion 3. The image forming portion 3 forms an image on a sheet supplied from the sheet feed portion 4, based on image data.

The control portion 5 includes control equipment such as a CPU, a ROM, and a RAM. The CPU is a processor that executes various calculation processes. The ROM is a nonvolatile storage device in which various information such as control programs for causing the CPU to execute various processes are preliminarily stored. The RAM is a volatile storage device. The RAM is used as a temporary storage memory (working area) for the various processes executed by the CPU. In the control portion 5, the CPU executes the various control programs preliminarily stored in the ROM. This allows the image forming apparatus 100 to be controlled comprehensively by the control portion 5. It is noted that the control portion 5 may be formed as an electronic circuit such as an integrated circuit (ASIC), and may be a control portion provided independently of a main control portion that comprehensively controls the image forming apparatus 100.

The operation/display portion 6 includes a display portion and an operation portion, wherein the display portion is, for example, a liquid crystal display and displays various types of information in response to control instructions from the control portion 5, and the operation portion is, for example, operation keys or a touch panel for inputting various types of information to the control portion 5 in response to user operations.

The storage portion 7 is a nonvolatile storage device. The storage portion 7 is, for example: a nonvolatile memory such as a flash memory or an EEPROM; an SSD (Solid State Drive); or an HDD (Hard Disk Drive).

[Configuration of Image Forming Portion 3]

Next, a configuration of the image forming portion 3 is described with reference to FIG. 2 and FIG. 3. Here, FIG. 3 is a schematic cross-sectional diagram showing a configuration of four image forming units 11, an intermediate transfer belt 13, and a secondary transfer roller 14.

As shown in FIG. 2, the image forming portion 3 includes the four image forming units 11, two laser scanning units 12, the intermediate transfer belt 13, the secondary transfer roller 14, a fixing device 15, a sheet discharge tray 16, four toner containers 17, and four container storage portions 18.

The four image forming units 11 are arranged in alignment along the front-rear direction D2 of the image forming apparatus 100. The four image forming units 11 respectively correspond to Y (yellow), C (cyan), M (magenta), and K (black) in order from the front side of the image forming apparatus 100. The four image forming units 11 are respectively configured to form toner images of corresponding colors.

Figure 3:
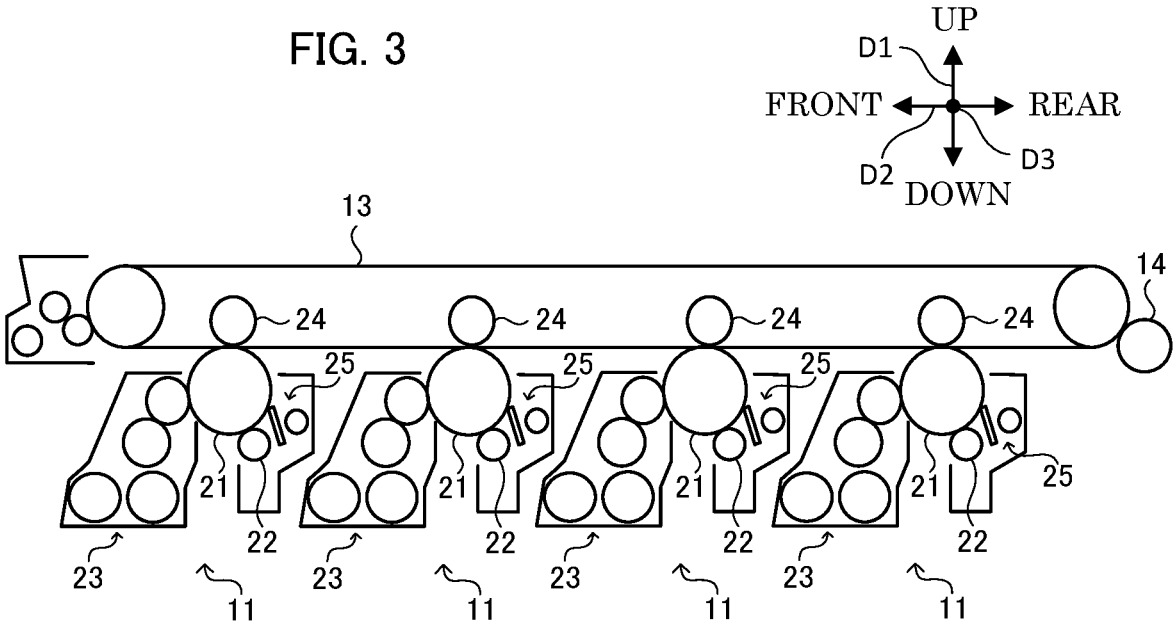
FIG. 3 is a diagram showing a configuration of a periphery of an intermediate transfer belt in the image forming apparatus according to the embodiment of the present disclosure.

As shown in FIG. 3, each of the four image forming units 11 includes a photoconductor drum 21, a charging roller 22, a developing device 23, a primary transfer roller 24, and a drum cleaning portion 25. It is noted that the four image forming units 11 have a common configuration except for the color of the toner stored in the developing device 23.

The photoconductor drum 21 carries a toner image. The charging roller 22 electrically charges the surface of the photoconductor drum 21. The developing device 23 develops, by using developer including toner, an electrostatic latent image formed on the surface of the photoconductor drum 21. The developer is, for example, two-component developer which contains magnetic carrier and non-magnetic toner. The primary transfer roller 24 transfers a toner image that is formed on the photoconductor drum 21 by the developing device 23, to the intermediate transfer belt 13. The drum cleaning portion 25 removes toner that has adhered to the surface of the photoconductor drum 21.

The two laser scanning units 12 are arranged in alignment along the front-rear direction D2 of the image forming apparatus 100. Among the two laser scanning units 12, a laser scanning unit 12 located on the front side of the image forming apparatus 100 forms an electrostatic latent image on each of: the photoconductor drum 21 of the image forming unit 11 corresponding to Y (yellow); and the photoconductor drum 21 of the image forming unit 11 corresponding to C (cyan). In addition, among the two laser scanning units 12, a laser scanning unit 12 located on the rear side of the image forming apparatus 100 forms an electrostatic latent image on each of: the photoconductor drum 21 of the image forming unit 11 corresponding to M (magenta); and the photoconductor drum 21 of the image forming unit 11 corresponding to K (black).

The intermediate transfer belt 13 is an endless belt member onto which toner images are transferred from the surfaces of the photoconductor drums 21. The intermediate transfer belt 13 is stretched, with a predetermined tension, between a driving roller and a stretch roller that are arranged to be separate from each other along the front-rear direction D2 of the image forming apparatus 100. The intermediate transfer belt 13 moves along the front-rear direction D2 of the image forming apparatus 100 as the driving roller is rotationally driven by a driving force supplied from a power source (not shown).

The secondary transfer roller 14 transfers the toner images adhered to the surface of the intermediate transfer belt 13, to a sheet supplied from the sheet feed portion 4.

The fixing device 15 fuses and fixes, to the sheet, the toner image transferred to the sheet by the secondary transfer roller 14.

The sheet with the toner image fixed by the fixing device 15 is discharged onto the sheet discharge tray 16.

The four toner containers 17 are arranged in alignment along the front-rear direction D2 of the image forming apparatus 100. The four toner containers 17 respectively correspond to Y (yellow), C (cyan), M (magenta), and K (black) in order from the front side of the image forming apparatus 100. The toner containers 17 respectively store toner of corresponding colors. In addition, the toner containers 17 respectively supply the toner stored therein to the developing devices 23 of the image forming units 11 corresponding to the colors of the toner stored therein. In addition, the toner stored in the toner containers 17 is supplied to the developing devices 23 via toner conveyance portions 19 (see FIG. 4). The toner containers 17 are an example of a storage case of the present disclosure. In addition, the toner conveyance portions 19 are an example of a developer conveyance portion of the present disclosure. In addition, the toner is an example of developer of the present disclosure.

The four container storage portions 18 are arranged in alignment along the front-rear direction D2 of the image forming apparatus 100. The four container storage portions 18 respectively correspond to the toner containers 17 of Y (yellow), C (cyan), M (magenta), and K (black) in order from the front side of the image forming apparatus 100. The container storage portions 18 respectively store the corresponding toner containers 17.

[Configurations of Toner Containers 17 and Toner Conveyance Portions 19]

Figure 4:
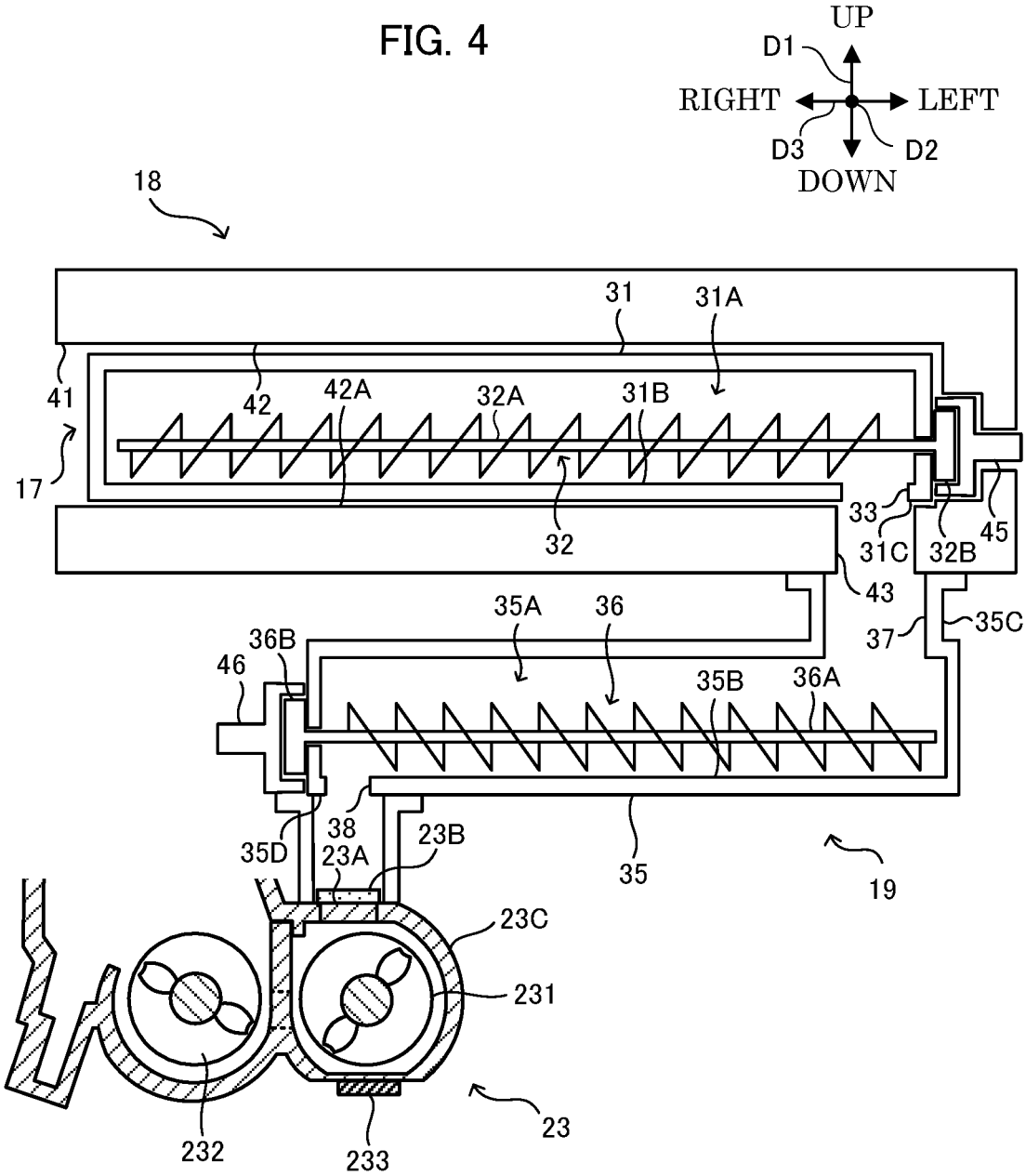
FIG. 4 is a diagram showing a configuration of a toner container, a toner conveyance portion, and a developing device in the image forming apparatus according to the embodiment of the present disclosure.

Next, the configurations of the toner containers 17 and the toner conveyance portions 19 are described with reference to FIG. 1, FIG. 2, and FIG. 4. FIG. 4 is a schematic cross-sectional diagram showing a configuration of a toner container 17 and a toner conveyance portion 19 corresponding to Y (yellow).

As shown in FIG. 4, the toner container 17 includes a main body portion 31, a first conveyance screw 32, and a toner discharge port 33. It is noted that the four toner containers 17 have a common configuration except for the color of the toner stored therein. Each toner container 17 stores the toner to be supplied to the developing device 23, and conveys the toner by driving the first conveyance screw 32.

The main body portion 31 is elongated in the left-right direction D3 of the image forming apparatus 100. For example, the main body portion 31 is formed in the shape of a rectangular prism elongated in the left-right direction D3. As shown in FIG. 4, a toner storage space 31A for storing the toner is formed inside the main body portion 31. In addition, the toner discharge port 33 is formed in a bottom portion 31B of the main body portion 31, wherein the toner stored in the toner storage space 31A is discharged through the toner discharge port 33. The toner discharge port 33 is provided at a first end portion 31C of the bottom portion 31B at a left-side end thereof.

The first conveyance screw 32 is provided in the toner storage space 31A. The first conveyance screw 32 includes a rotation shaft 32A that is elongated in the left-right direction D3, namely, in the longitudinal direction of the main body portion 31. The rotation shaft 32A is rotatably supported by the main body portion 31. The first conveyance screw 32 rotates upon receiving a driving force supplied from a first driving portion 44 (see FIG. 1), and conveys the toner in the toner storage space 31A to the toner discharge port 33. For example, a gear 32B configured to receive the driving force supplied from the first driving portion 44 is provided on the rotation shaft 32A of the first conveyance screw 32. The first conveyance screw 32 is an example of a first conveyance member of the present disclosure.

As shown in FIG. 4, the container storage portion 18 includes an opening portion 41, an attachment portion 42, a toner conveyance path 43, the first driving portion 44, and a power transmission portion 45. It is noted that the four container storage portions 18 have a common configuration except for the toner container 17 stored therein.

The opening portion 41 is provided in a right-side surface of a housing of the image forming apparatus 100. The opening portion 41 is covered with an exterior cover of the housing of the image forming apparatus 100. The opening portion 41 is communicated to the attachment portion 42.

The attachment portion 42 forms, in the housing of the image forming apparatus 100, a storage space for storing the toner container 17. The toner container 17 is attached to the attachment portion 42 in a detachable manner. As shown in FIG. 4, the attachment portion 42 is communicated to the opening portion 41 and is formed to be elongated in the left-right direction D3. The attachment portion 42 includes a placement surface 42A on which the toner container 17 is placed.

The toner conveyance path 43 is a path in which moves the toner supplied from the toner container 17 attached to the attachment portion 42. The toner conveyance path 43 extends downward from the placement surface 42A of the attachment portion 42. The toner conveyance path 43 is connected to the toner discharge port 33 of the toner container 17 attached to the attachment portion 42.

The first driving portion 44 generates a driving force to be supplied to the first conveyance screw 32 of the toner container 17. For example, the first driving portion 44 is a motor. The driving of the first driving portion 44 is controlled by a driving control portion 51 (see FIG. 1) of the control portion 5.

The power transmission portion 45 transmits the driving force generated by the first driving portion 44 to the first conveyance screw 32 of the toner container 17 attached to the attachment portion 42. The power transmission portion 45 is configured to be coupled with the gear 32B of the toner container 17. The power transmission portion 45 is coupled with the gear 32B when the toner container 17 is attached to the attachment portion 42.

As shown in FIG. 4, the toner conveyance portion 19 includes a main body portion 35, a second conveyance screw 36, a toner supply port 37, and a toner discharge port 38. It is noted that the four toner conveyance portions 19 have a common configuration except for the color of the toner conveyed thereby. The toner conveyance portion 19 conveys the toner supplied from the toner container 17 by driving the second conveyance screw 36.

The main body portion 35 is elongated in the left-right direction D3 of the image forming apparatus 100. For example, the main body portion 35 is formed in the shape of a rectangular prism elongated in the left-right direction D3. As shown in FIG. 4, a toner conveyance space 35A for conveying the toner is formed inside the main body portion 35. In addition, the toner supply port 37 is formed in an upper portion of the main body portion 35, wherein the toner discharged from the toner container 17 is supplied through the toner supply port 37. The toner supply port 37 is provided at an end portion 35C of the upper portion of the main body portion 35 at a left-side end thereof. In addition, the toner discharge port 38 is formed in a bottom portion 35B of the main body portion 35, wherein the toner conveyed in the toner conveyance space 35A is discharged through the toner discharge port 38. The toner discharge port 38 is provided at an end portion 35D of the bottom portion 35B at a right-side end thereof. It is noted that the toner container 17 and the toner conveyance portion 19 may be disposed such that the extension direction (longitudinal direction) of the main body portion 31 of the toner container 17 is perpendicular to the extension direction (longitudinal direction) of the main body portion 35 of the toner conveyance portion 19.

The second conveyance screw 36 is provided in the toner conveyance space 35A. The second conveyance screw 36 includes a rotation shaft 36A that is elongated in the left-right direction D3, namely, in the longitudinal direction of the main body portion 35. The rotation shaft 36A is rotatably supported by the main body portion 35. The second conveyance screw 36 rotates upon receiving a driving force supplied from a second driving portion 47 (see FIG. 1), and conveys the toner in the toner conveyance space 35A to the toner discharge port 38. For example, a gear 36B configured to receive the driving force supplied from the second driving portion 47 is provided on the rotation shaft 36A of the second conveyance screw 36. The second conveyance screw 36 is an example of a second conveyance member of the present disclosure.

The second driving portion 47 generates a driving force supplied to the second conveyance screw 36 of the toner conveyance portion 19. For example, the second driving portion 47 is a motor. The driving of the second driving portion 47 is controlled by the driving control portion 51 (see FIG. 1) of the control portion 5.

A power transmission portion 46 transmits the driving force generated by the second driving portion 47 to the second conveyance screw 36 of the toner conveyance portion 19. The power transmission portion 46 is configured to be coupled with the gear 36B of the toner conveyance portion 19.

The toner discharge port 38 of the toner conveyance portion 19 is connected to a supply port 23A of the developing device 23. The toner discharged from the toner discharge port 38 is supplied from the supply port 23A to a developer reserving portion 23C of the developing device 23. The supply port 23A is provided with a shutter 23B (opening/closing member) for opening and closing the supply port 23A. For example, when the developing device 23 is attached to the housing of the image forming apparatus 100, the shutter 23B is moved from a closing position to close the supply port 23A to an opening position to open the supply port 23A. In addition, when the developing device 23 is pulled out from the housing of the image forming apparatus 100, the shutter 23B is moved from the opening position to the closing position to close the supply port 23A.

[Configuration of Developing Device 23]

FIG. 4 shows a partial configuration of a developing device 23 that corresponds to Y (yellow). The developing device 23 conveys toner that has been supplied from the supply port 23A to the developer reserving portion 23C, while stirring the toner by a first stirring member 231 and a second stirring member 232. The developing device 23 uses the toner to execute a developing process.

A toner sensor 233 (an example of a developer detection portion of the present disclosure) is disposed at the bottom of the developer reserving portion 23C. The toner sensor 233 is disposed in contact with a contacted portion of the bottom of the developer reserving portion 23C near the developer stored in the developer reserving portion 23C, and configured to detect magnetic permeability of the developer. For example, the toner sensor 233 is disposed and fixed in contact with a bottom surface (an outer surface) of the developer reserving portion 23C. The bottom surface of the developer reserving portion 23C is formed in the shape of a flat surface (to be flat) so as to be in surface contact with the toner sensor 233. It is noted that the toner sensor 233 may be fixed to the bottom surface of the developer reserving portion 23C by being pressed against the bottom surface via an elastic member such as sponge or rubber.

The toner sensor 233 detects concentration of toner included in the developer reserved in the developer reserving portion 23C. Specifically, the toner sensor 233 measures the magnetic permeability of the developer based on the magnetism that is received by a coil from the toner, and detects the concentration of toner based on a voltage corresponding to the magnetic permeability. When the toner is consumed as the developing is performed, the ratio (percentage) of the toner to the developer changes, and thereby the magnetic permeability of the developer changes. For example, when the ratio of the toner to the developer decreases, the magnetic permeability of the developer increases, and the voltage level increases. The toner sensor 233 determines the concentration of toner in the developer based on the voltage level corresponding to the detected magnetic permeability. The toner sensor 233 outputs the detected concentration of toner to the control portion 5. It is noted that the toner sensor 233 may output, to the control portion 5, a voltage corresponding to the detected magnetic permeability, as an output signal (voltage signal). In this case, the control portion 5 determines the concentration of toner in the developer based on the output signal received by the control portion 5.

The concentration of toner changes as the remaining amount of toner changes. As a result, the control portion 5 can detect the remaining amount of toner contained in the developer reserved in the developer reserving portion 23C, based on the concentration of toner detected by the toner sensor 233. That is, the control portion 5 acquires the concentration of toner in the developer (the magnetic permeability) detected by the toner sensor 233, and detects the remaining amount of toner in the developer based on the acquired concentration of toner in the developer. In addition, when the detected remaining amount of toner becomes smaller than a predetermined amount, the control portion 5 slides the shutter 23B to open the supply port 23A and supplies the toner from the toner container 17 to the developing device 23 by driving the first conveyance screw 32 and the second conveyance screw 36. In this way, the control portion 5 performs a control such that the concentration of toner in the developer in the developing device 23 is kept to be within a predetermined range.

Meanwhile, a conventional image forming apparatus has a problem that the toner remains in the toner conveyance portion 19 during a toner supply process due to, for example, the shape of the conveyance path of the toner conveyance portion 19. In addition, a conventional image forming apparatus has a problem that the driving load of the toner conveyance portion 19 increases as it drives the second conveyance screw 36 so often than necessary to prevent the toner from remaining in the toner conveyance portion 19.

On the other hand, in the image forming apparatus 100 according to the embodiment of the present disclosure, as described below, it is possible to prevent the toner from remaining in the toner conveyance portion 19 and reduce the driving load of the toner conveyance portion 19.

[Configuration of Control Portion 5]

Next, the configuration of the control portion 5 is described with reference to FIG. 1.

A toner conveyance setting program for causing the CPU to execute a toner conveyance setting process (see FIG. 5) that is described below is preliminarily stored in the ROM of the control portion 5. It is noted that the toner conveyance setting program may be recorded on a computer-readable recording medium such as a CD, a DVD, or a flash memory, and may be installed from the recording medium to the storage portion 7.

Specifically, as shown in FIG. 1, the control portion 5 includes a driving control portion 51, a toner detecting portion 52, a time measuring portion 53, and a determination processing portion 54. Specifically, the CPU of the control portion 5 executes the toner conveyance setting program stored in the ROM. This allows the control portion 5 to function as the driving control portion 51, the toner detecting portion 52, the time measuring portion 53, and the determination processing portion 54.

The driving control portion 51 controls the rotational driving of the first conveyance screw 32 by controlling the driving of the first driving portion 44. In addition, the driving control portion 51 controls the rotational driving of the second conveyance screw 36 by controlling the driving of the second driving portion 47. The driving control portion 51 controls the supplied amount (replenished amount) of toner supplied from the toner container 17 to the developing device 23 by controlling the driving of the first conveyance screw 32 and the second conveyance screw 36.

For example, the driving control portion 51 drives the first conveyance screw 32 and the second conveyance screw 36 for a time period corresponding to a supplied amount of toner that is calculated based on a remaining amount of toner in the developing device 23.

The toner detecting portion 52 is provided in the developing device 23 and configured to detect the toner supplied from the toner conveyance portion 19. The toner detecting portion 52 detects concentration of toner in the developing device 23 based on an output signal output from the toner sensor 233. In addition, the toner detecting portion 52 detects the remaining amount of toner in the developing device 23 based on the concentration of toner. The toner detecting portion 52 is an example of a developer detecting portion of the present disclosure.

The time measuring portion 53 measures a required time required for the toner stored in the toner container 17 to reach the developing device 23. Specifically, the time measuring portion 53 measures a time period (required time) between the time when the first conveyance screw 32 starts to be driven and the time when the toner detecting portion 52 detects the toner.

For example, in a state where the toner does not stay (is not present) in the toner conveyance space 35A (see FIG. 4) of the toner conveyance portion 19, the time measuring portion 53 starts to measure the time period at a timing when the first conveyance screw 32 and the second conveyance screw 36 start to be driven by the driving control portion 51. The toner that has been discharged from the toner container 17 to the toner conveyance portion 19 by the first conveyance screw 32 thus driven, moves in the toner conveyance space 35A in the toner conveyance portion 19 by the second conveyance screw 36 thus driven and is supplied to the developing device 23. The toner supplied to the developing device 23 is detected by the toner sensor 233. For example, the toner sensor 233 detects a change in the concentration of toner. When the toner detecting portion 52 acquires an output signal from the toner sensor 233, the time measuring portion 53 stops measuring the time period, and calculates the required time. In this way, the time measuring portion 53 measures the required time between the time when the first conveyance screw 32 starts to be driven and the time when the toner reaches the developing device 23. The time measuring portion 53 records the measured required time in the storage portion 7.

Here, when the image forming apparatus 100 is powered on for the first time, the toner does not stay (is not present) in the toner conveyance spaces 35A of the toner conveyance portions 19. As a result, the time measuring portions 53 measure the required time when the image forming apparatus 100 is powered on for the first time.

The determination processing portion 54 determines whether or not the toner stays (is present) in the toner conveyance space 35A (see FIG. 4) of the toner conveyance portion 19. For example, the determination processing portion 54 determines whether or not the image forming apparatus 100 has been powered on for the first time. Upon determining that the image forming apparatus 100 has been powered on for the first time, the determination processing portion 54 determines that the toner does not stay (is not present) in the toner conveyance space 35A of the toner conveyance portion 19. Here, information related to power-on/off may be recorded in the storage portion 7. The determination processing portion 54 may consult the storage portion 7 to determine whether or not the image forming apparatus 100 has been powered on for the first time.

In addition, the determination processing portion 54 may determine, based on a detection result of a sensor (not shown) that is configured to detect the remaining amount of toner in the toner conveyance space 35A, whether or not the toner is present in the toner conveyance space 35A. In addition, the determination processing portion 54 may determine that the toner is not present in the toner conveyance space 35A, when the toner conveyance portion 19 has been replaced with another one. It is noted that when the determination processing portion 54 determines that the toner stays in the toner conveyance space 35A, the driving control portion 51 may drive the second conveyance screw 36 to discharge the toner from the toner conveyance space 35A of the toner conveyance portion 19.

When the time measuring portion 53 has measured the required time, the driving control portion 51 sets the driving time of the second conveyance screw 36 based on the required time.

Specifically, the driving control portion 51 calculates the supplied amount (replenished amount) of toner based on the remaining amount of toner in the developing device 23 that is detected by the toner detecting portion 52. In addition, the driving control portion 51 calculates the driving time of the first conveyance screw 32 corresponding to the supplied amount of toner. It is noted that the driving control portion 51 may calculate the rotation speed and the rotation amount of the first conveyance screw 32.

The driving control portion 51 causes the first driving portion 44 to rotationally drive the first conveyance screw 32 for the calculated driving time. In addition, the driving control portion 51 causes the second driving portion 47 to rotationally drive the second conveyance screw 36.

After the driving time passes, the driving control portion 51 causes the first driving portion 44 to stop driving the first conveyance screw 32, and causes the second driving portion 47 to maintain driving the second conveyance screw 36 for the required time after stopping the first conveyance screw 32. Subsequently, after the required time passes, the driving control portion 51 causes the second driving portion 47 to stop driving the second conveyance screw 36. In this way, the driving control portion 51 controls the driving of the first conveyance screw 32 and the second conveyance screw 36 individually. In addition, after driving the first conveyance screw 32 and the second conveyance screw 36 for a predetermined time period, the driving control portion 51 stops driving the first conveyance screw 32, and then after a driving time of the second conveyance screw 36 passes, stops driving the second conveyance screw 36.

As described above, the driving control portion 51 sets the driving time of the second conveyance screw 36 based on the required time measured by the time measuring portion 53. In addition, the driving control portion 51 drives the second conveyance screw 36 for the set driving time during the toner supply process (replenishing process).

[Toner Conveyance Setting Process]

Figure 5:
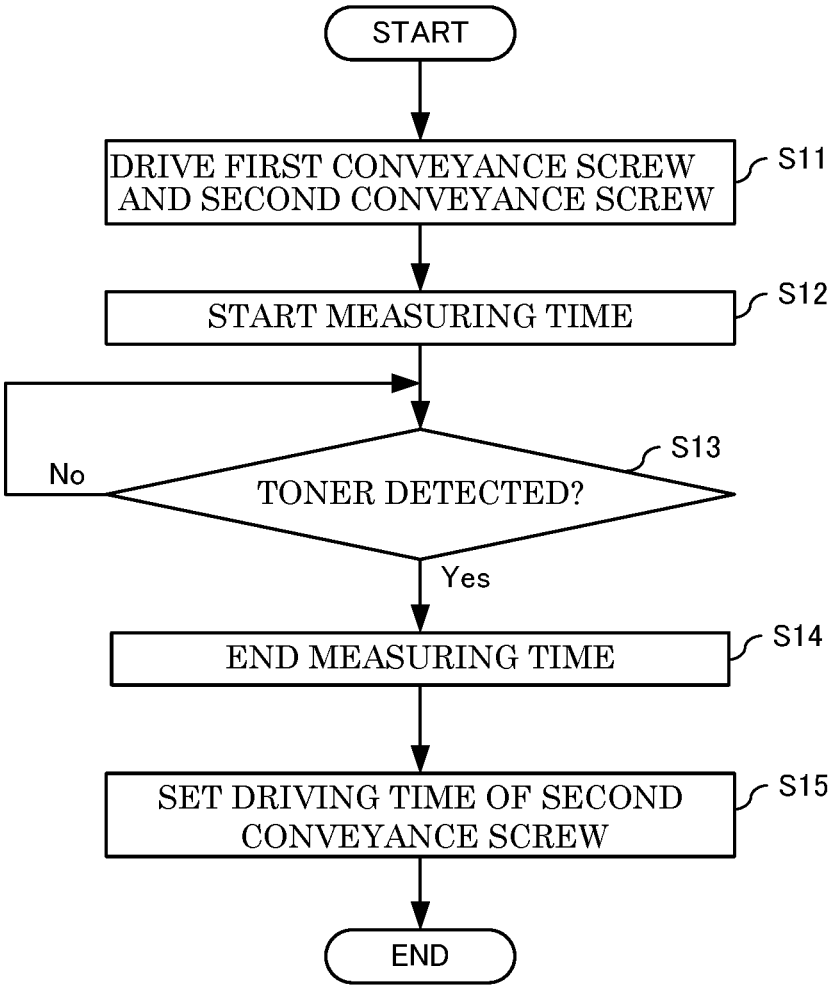
FIG. 5 is a flowchart showing an example of a toner conveyance setting process executed by the image forming apparatus according to the embodiment of the present disclosure.

In the following, with reference to FIG. 5, a description is given of an example of the procedure of the toner conveyance setting process executed by the control portion 5 in the image forming apparatus 100. Here, steps S11, S12, . . . represent numbers assigned to the processing procedures (steps) executed by the control portion 5. It is noted that one or more steps included in the toner conveyance setting process described here may be omitted as appropriate. In addition, the steps of the toner conveyance setting process may be executed in a different order as far as the same acts and effects are produced. Furthermore, although the control portion 5 of the image forming apparatus 100 executes the steps of the toner conveyance setting process in the example of the present embodiment, in another embodiment, a plurality of other processors may execute the steps of the toner conveyance setting process in a distributed manner. The present disclosure may be recognized as an invention of a toner conveyance setting method (a developer conveyance setting method) that executes one or more steps included in the toner conveyance setting process.

Here, for example, when the image forming apparatus 100 is powered on for the first time, the control portion 5 executes the toner conveyance setting process.

First, in step S11, the control portion 5 drives the first conveyance screw 32 and the second conveyance screw 36. With this operation, the toner stored in the toner container 17 starts to be supplied to the developing device 23.

Subsequently, in step S12, the control portion 5 starts measuring the time. That is, the control portion 5 starts measuring the time at a timing when the first conveyance screw 32 and the second conveyance screw 36 start to be driven. Step S12 is an example of a time measuring step of the present disclosure.

Subsequently, in step S13, the control portion 5 determines whether or not the toner in the developing device 23 has been detected. When the control portion 5 determines that the toner in the developing device 23 has been detected (S13: Yes), the process moves to step S14. The control portion 5 waits until the toner is detected (S13: No). Step S13 is an example of a developer detecting step of the present disclosure.

In step S14, the control portion 5 ends measuring the time. That is, the control portion 5 measures the required time between the time when the first conveyance screw 32 starts to be driven and the time when the toner is detected in the developing device 23. Step S14 is an example of the time measuring step of the present disclosure.

In step S15, the control portion 5 sets the driving time of the second conveyance screw 36 based on the required time. Step S15 is an example of a driving time setting step of the present disclosure. Upon setting the driving time, the control portion 5 drives the second conveyance screw 36 for a time period corresponding to the driving time during, for example, the next toner supply process (replenishing process). Specifically, for example, during the next toner supply process, the driving control portion 51 drives the first conveyance screw 32 and the second conveyance screw 36 for a time period corresponding to a supplied amount of toner that is calculated based on a remaining amount of toner, and after driving the first conveyance screw 32 and the second conveyance screw 36 for the time period, the driving control portion 51 stops driving the first conveyance screw 32, and then after the driving time passes, stops driving the second conveyance screw 36.

As described above, in the image forming apparatus 100, the required time between the time when the first conveyance screw 32 starts to be driven and the time when the toner is detected in the developing device 23, is measured, and based on the required time, the driving time of the second conveyance screw 36 is set. This allows, during the toner supply process, the toner that has been supplied from the toner container 17 to the toner conveyance portion 19, to be conveyed to the developing device 23 without remaining in the toner conveyance portion 19. In addition, the driving of the second conveyance screw 36 is stopped at a timing when all of the toner supplied from the toner container 17 to the toner conveyance portion 19 has been supplied to the developing device 23. As a result, it is possible to prevent the toner from remaining in the toner conveyance portion 19 and reduce the driving load of the toner conveyance portion 19.

Meanwhile, the required time may vary depending on the environment such as the temperature or the humidity around the image forming apparatus 100. In view of this, the image forming apparatus 100 may have the following configuration.

Figure 6:
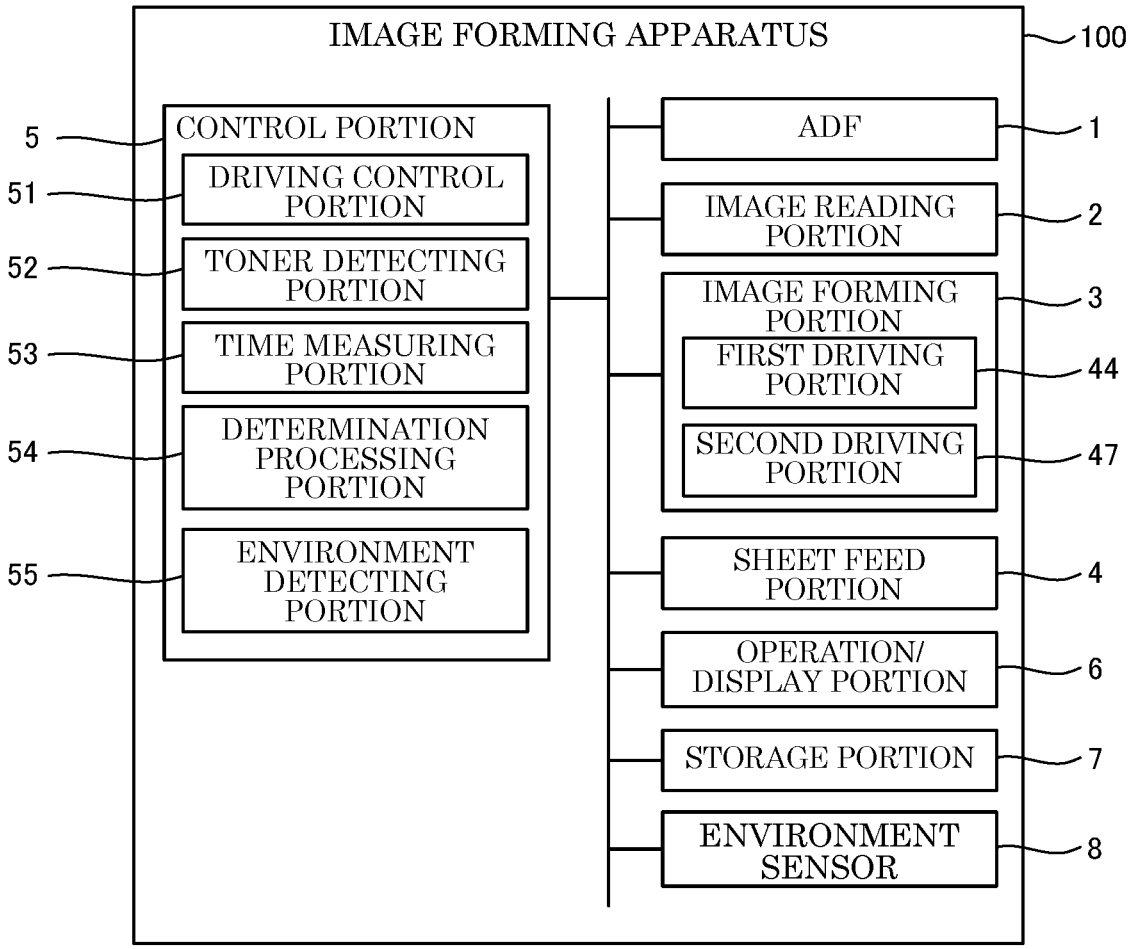
FIG. 6 is a diagram showing another system configuration of the image forming apparatus according to an embodiment of the present disclosure.

In another embodiment of the image forming apparatus 100, for example, as shown in FIG. 6, the image forming apparatus 100 may further include an environment sensor 8 and an environment detecting portion 55, wherein the environment sensor 8 detects the environment around the image forming apparatus 100, and the environment detecting portion 55 detects an environment value (for example, temperature or humidity) based on the detection result of the environment sensor 8. For example, the environment sensor 8 always measures the temperature around the image forming apparatus 100, and outputs the measurement result to the environment detecting portion 55. The environment detecting portion 55 acquires the temperature based on the measurement result, and records the acquired temperature in the storage portion 7.

In the configuration shown in FIG. 6, when an amount of change between: an environment value that was detected by the environment detecting portion 55 when the required time was measured last time; and a current environment value detected by the environment detecting portion 55, has exceeded a threshold, the time measuring portion 53 remeasures the required time. Subsequently, the driving control portion 51 sets again (adjusts) the driving time of the second conveyance screw 36 based on the required time remeasured by the time measuring portion 53.

It is noted that when the required time is remeasured, the toner may have remained in the toner conveyance portion 19 due to an environmental change. In this case, before the toner detecting portion 52 detects toner discharged from the toner container 17 by the first conveyance screw 32 that starts to be driven, the toner detecting portion 52 may detect the toner having remained in the toner conveyance portion 19.

As a result, when the required time is remeasured, the required time is desirably remeasured after the toner having remained in the toner conveyance portion 19 is discharged. In addition, since presumably a small amount of toner should remain in the toner conveyance portion 19, the toner detecting portion 52 may cancel (disregard) the detection result of the toner that has remained in the toner conveyance portion 19, based on an increased amount of concentration of toner. This allows the time measuring portion 53 to appropriately measure the required time required for the toner discharged from the toner container 17 by the first conveyance screw 32 that starts to be driven to reach the developing device 23.

Figure 7:
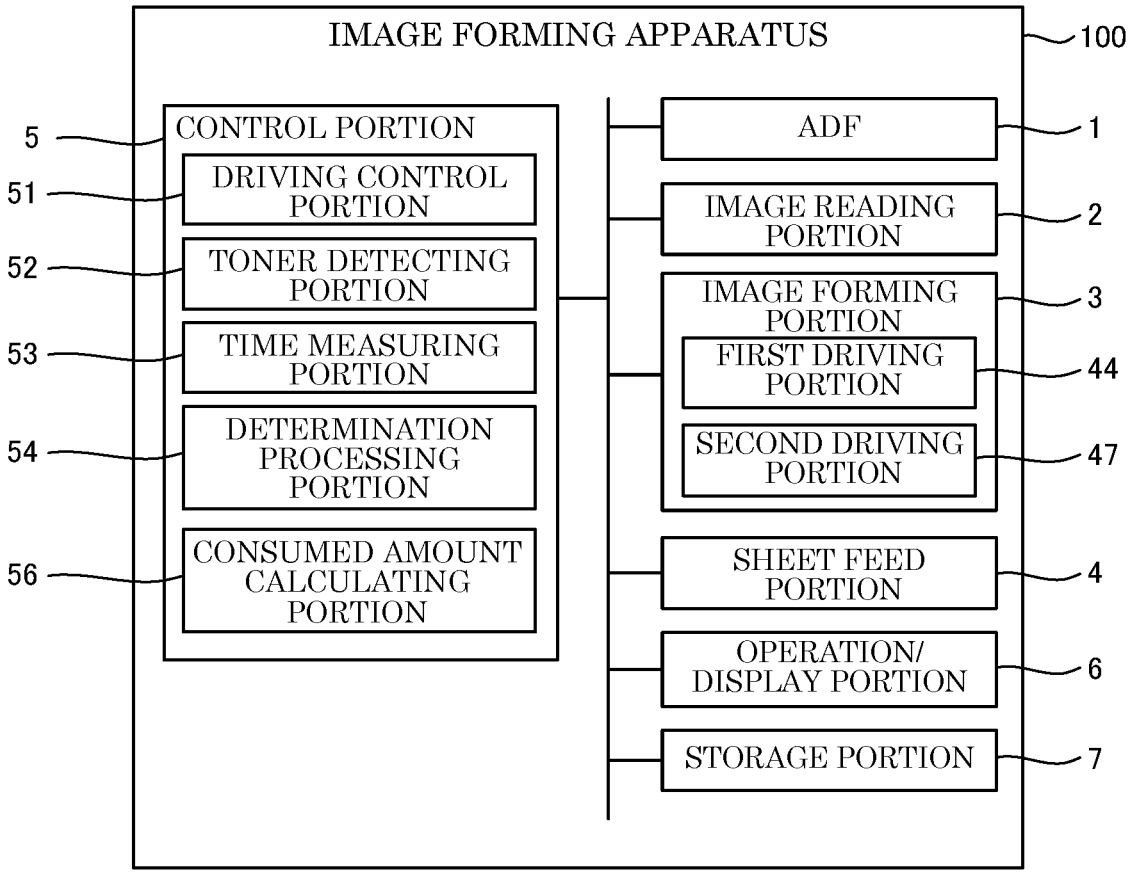
FIG. 7 is a diagram showing another system configuration of the image forming apparatus according to an embodiment of the present disclosure.

In addition, in another embodiment of the image forming apparatus 100, for example, as shown in FIG. 7, the image forming apparatus 100 may further include a consumed amount calculating portion 56 that calculates a consumed amount of toner stored in the toner container 17. In this case, the determination processing portion 54 determines whether or not the consumed amount calculated by the consumed amount calculating portion 56 has exceeded a threshold. Upon determining that the consumed amount has exceeded the threshold, the time measuring portion 53 measures the required time, and the driving control portion 51 sets the driving time of the second conveyance screw 36 based on the required time measured by the time measuring portion 53.

Figure 8:
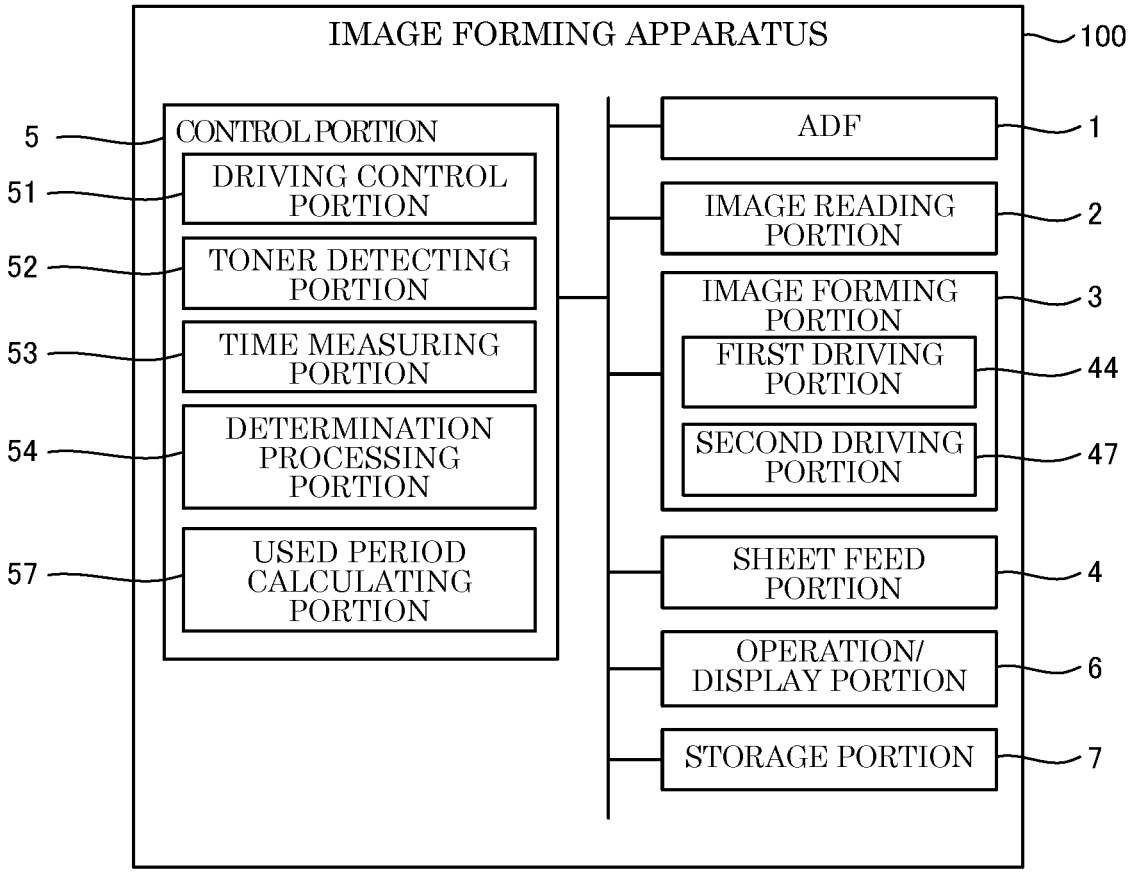
FIG. 8 is a diagram showing another system configuration of the image forming apparatus according to an embodiment of the present disclosure.

In addition, in another embodiment of the image forming apparatus 100, for example, as shown in FIG. 8, the image forming apparatus 100 may further include a used period calculating portion 57 that calculates a used period for which the toner stored in the toner container 17 has been used. In this case, the determination processing portion 54 determines whether or not the used period calculated by the used period calculating portion 57 has exceeded a threshold. Upon determining that the used period has exceeded the threshold, the time measuring portion 53 measures the required time, and the driving control portion 51 sets the driving time of the second conveyance screw 36 based on the required time measured by the time measuring portion 53.

The conveyance efficiency, such as the conveyance amount or the conveyance speed, of the toner stored in the toner conveyance portion 19 may change depending on the consumed amount or the used period. In this regard, with the configuration shown in FIG. 7 or FIG. 8, even if such a change has occurred, it is possible to adjust (correct) the driving time of the second conveyance screw 36 by remeasuring the required time.

Here, the time measuring portion 53 may measure the required time while the toner is supplied to the developing device 23, namely, during execution of the toner supply process.

For example, when one of; the amount of change of the environment around the image forming apparatus 100; the consumed amount of toner stored in the toner container 17; and the used period of toner stored in the toner container 17, has exceeded a threshold while the toner stored in the toner container 17 is supplied to the developing device 23 based on the first driving time set by the driving control portion 51, the time measuring portion 53 measures the required time.

Subsequently, the driving control portion 51 corrects the first driving time to the second driving time based on the required time measured by the time measuring portion 53, and causes the toner stored in the toner container 17 to be supplied to the developing device 23 based on the second driving time after the correction. It is noted that the time measuring portion 53 may perform a process to add a difference (an amount of correction) between the first driving time and the newly measured driving time, to the first driving time. This makes it possible to maintain an optimal driving time of the second conveyance screw 36 at a time point when the supply of the toner to the developing device 23 ends.

Figure 9:
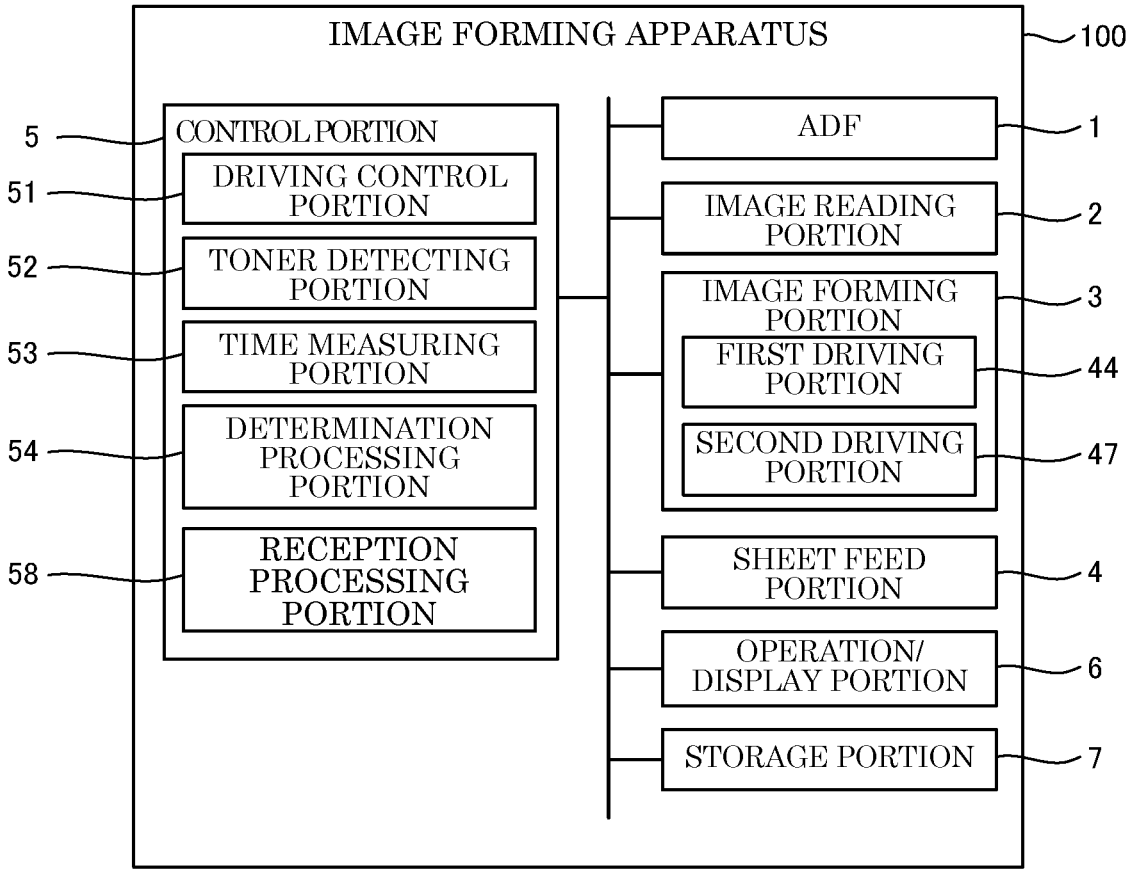
FIG. 9 is a diagram showing another system configuration of the image forming apparatus according to an embodiment of the present disclosure.

In addition, in another embodiment of the image forming apparatus 100, for example, as shown in FIG. 9, the image forming apparatus 100 may further include a reception processing portion 58 that receives a threshold set by a user. For example, the user inputs, on a setting screen displayed on the operation/display portion 6, a threshold for the amount of change of the environment around the image forming apparatus 100, a threshold for the consumed amount of toner stored in the toner container 17, or a threshold for the used period of toner stored in the toner container 17. The reception processing portion 58 receives the threshold input by the user. The time measuring portion 53 measures the required time based on the threshold received by the reception processing portion 58. The driving control portion 51 sets the driving time of the second conveyance screw 36 based on the required time measured by the time measuring portion 53.

This allows the user to adjust the frequency of setting the driving time of the second conveyance screw 36 to a desired frequency.

In addition, in another embodiment of the image forming apparatus 100, in a case where the toner container 17 has been replaced with another one, in a case where the cover of the image forming apparatus 100 has been opened or closed, or in a case where the image forming apparatus 100 has been powered on or off, the time measuring portion 53 measures the required time, and the driving control portion 51 sets the driving time of the second conveyance screw 36 based on the required time measured by the time measuring portion 53. It is noted that the control portion 5 may acquire identification information of the toner container 17 to determine whether or not the toner container 17 has been changed (replaced).

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a storage case storing developer that is supplied to a developing device, the storage case configured to convey the developer by driving a first conveyance member;

a developer conveyance portion configured to convey, by driving a second conveyance member, the developer supplied from the storage case;

a developer detecting portion provided in the developing device and configured to detect the developer supplied from the developer conveyance portion;

a time measuring portion configured to measure a required time between a time when the first conveyance member starts to be driven and a time when the developer detecting portion detects the developer; and a driving control portion configured to set a driving time of the second conveyance member based on the required time measured by the time measuring portion.

2. The image forming apparatus according to claim 1, wherein the driving control portion controls driving of the first conveyance member and the second conveyance member individually, and the driving control portion, after driving the first conveyance member and the second conveyance member, stops driving the first conveyance member, and then after the driving time passes, stops driving the second conveyance member.

3. The image forming apparatus according to claim 1, wherein when the image forming apparatus is powered on for a first time, the time measuring portion measures the required time, and the driving control portion sets the driving time of the second conveyance member based on the required time measured by the time measuring portion.

4. The image forming apparatus according to claim 1, further comprising:

an environment detecting portion configured to detect an environment value that indicates an environment around the image forming apparatus, wherein when an amount of change between: an environment value that was detected by the environment detecting portion when the required time was measured last time; and a current environment value detected by the environment detecting portion, has exceeded a threshold, the time measuring portion remeasures the required time, and the driving control portion sets the driving time of the second conveyance member based on the required time remeasured by the time measuring portion.

5. The image forming apparatus according to claim 4, wherein when the amount of change, a consumed amount of the developer stored in the storage case, or a used period of the developer stored in the storage case has exceeded a threshold while the developer stored in the storage case is supplied to the developing device based on a first driving time set by the driving control portion, the time measuring portion measures the required time, and the driving control portion corrects the first driving time to a second driving time based on the required time measured by the time measuring portion, and causes the developer stored in the storage case to be supplied to the developing device based on the second driving time after a correction.

6. The image forming apparatus according to claim 4, further comprising:

a reception processing portion configured to receive a threshold set by a user, wherein the time measuring portion measures the required time based on the threshold received by the reception processing portion, and the driving control portion sets the driving time of the second conveyance member based on the required time measured by the time measuring portion.

7. The image forming apparatus according to claim 1, further comprising:

a consumed amount calculating portion configured to calculate a consumed amount of the developer stored in the storage case, wherein when the consumed amount calculated by the consumed amount calculating portion has exceeded a threshold, the time measuring portion measures the required time, and the driving control portion sets the driving time of the second conveyance member based on the required time measured by the time measuring portion.

8. The image forming apparatus according to claim 1, further comprising:

a used period calculating portion configured to calculate a used period for which the developer stored in the storage case has been used, wherein when the used period calculated by the used period calculating portion has exceeded a threshold, the time measuring portion measures the required time, and the driving control portion sets the driving time of the second conveyance member based on the required time measured by the time measuring portion.

9. The image forming apparatus according to claim 1, wherein in a case where the storage case has been replaced with another one, in a case where a cover of the image forming apparatus has been opened or closed, or in a case where the image forming apparatus has been powered on or off, the time measuring portion measures the required time, and the driving control portion sets the driving time of the second conveyance member based on the required time measured by the time measuring portion.

10. A developer conveyance setting method executed in an image forming apparatus that includes: a storage case storing developer that is supplied to a developing device, the storage case configured to convey the developer by driving a first conveyance member; and a developer conveyance portion configured to convey, by driving a second conveyance member, the developer supplied from the storage case, the developer conveyance setting method comprising:

a developer detecting step of detecting the developer supplied from the developer conveyance portion;

a time measuring step of measuring a required time between a time when the first conveyance member starts to be driven and a time when the developer is detected in the developer detecting step; and a driving time setting step of setting a driving time of the second conveyance member based on the required time measured in the time measuring step.

* * * * *